US007341466B1

(12) United States Patent
Kondo

(10) Patent No.: US 7,341,466 B1
(45) Date of Patent: Mar. 11, 2008

(54) CARD CONNECTOR

(75) Inventor: Takahiro Kondo, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/802,547

(22) Filed: May 23, 2007

(30) Foreign Application Priority Data

Nov. 1, 2006 (JP) ..... 2006-297936

(51) Int. Cl.
*H01R 13/62* (2006.01)

(52) U.S. Cl. ..... 439/159

(58) Field of Classification Search ..... 439/157, 439/159, 630, 607, 33, 155, 310, 333, 160, 439/328, 631–632, 608–610, 152, 345; 361/756
See application file for complete search history.

(56) References Cited

U.S. PATENT DOCUMENTS 6,394,827 B2 * 5/2002 Nogami ..... 439/159
6,840,786 B2 * 1/2005 Sato et al. ..... 439/159
6,976,860 B1 * 12/2005 Su ..... 439/159
7,033,190 B1 * 4/2006 Chen ..... 439/159
2005/0142914 A1 * 6/2005 Kodera et al. ..... 439/159

FOREIGN PATENT DOCUMENTS

| | | |
|---|---|---|
| JP | 11-086966 | 3/1999 |
| JP | 11-219756 | 8/1999 |
| JP | 2006-244744 | 9/2006 |
| JP | 2006-244774 | 9/2006 |

* cited by examiner

*Primary Examiner*—Edwin A. Leon
(74) *Attorney, Agent, or Firm*—Staas & Halsey LLP

(57) ABSTRACT

A card connector includes a card ejecting mechanism. A heart-shaped cam groove provided on a side surface of a main unit includes an extended valley groove extending from a valley groove toward an eject bar. The eject bar has a strip-like protruding section with a slanted guide edge face provided at the tip. When a preparatory operation is performed when a card is not inserted, a cam follower moves along inside the extended valley groove and then returns to its original position in the valley groove. When the preparatory operation is performed when the card is inserted, the eject bar is positioned near the valley groove so that the cam follower is guided by the guide edge face to an outgoing groove.

8 Claims, 14 Drawing Sheets

CROSS-SECTIONAL VIEW OF VIA—VIA

CROSS-SECTIONAL VIEW OF VIB—VIB

CROSS-SECTIONAL VIEW OF VIC—VIC

CARD CONNECTOR

CROSS REFERENCE TO RELATED APPLICATIONS

The present application is based on Japanese Priority Patent Application No. 2006-297936, filed on Nov. 1, 2006, the entire contents of which are hereby incorporated herein by reference.

BACKGROUND OF THE INVENTION

1. Field of the Invention

The present invention relates to card connectors, and more particularly to a card connector built in a portable personal computer, etc., and provided with a card ejecting mechanism in which an operation member is pushed in to eject an inserted card.

2. Description of the Related Art

A card connector provided with a card ejecting mechanism is built in a portable personal computer, etc. In order to eject a card, the user pushes the operation member by a predetermined stroke with his fingertip. However, it is disadvantageous in terms of appearance to have the operation member protruding out from the side of the personal computer.

To address this disadvantage, there is a commercially implemented card connector in which a heart-shaped cam referred to as a push-on/push-off switch is employed in the card ejecting mechanism. An operation edge of the operation member is usually pushed into the same level as the side surface of the personal computer. As a preparatory operation, the user pushes the operation edge with his finger tip so that the operation edge is temporarily pushed in and then the operation member protrudes from the side surface of the personal computer. Subsequently, as a main operation, the user pushes in the protruding operation edge to eject a card.

However, the problem with this card connector is that if the user pushes the operation edge when there is no card inserted, the operation edge protrudes from the side surface of the personal computer. As a result, the operation member needlessly protrudes from the side surface of the personal computer.

An improved version of this card connector is being prepared for commercialization. Specifically, when a card is not inserted, even if the user pushes the operation edge with his fingertip, the operation edge does not protrude from the side surface of the personal computer.

However, this card ejecting mechanism requires different operations when a card is inserted and when a card is not inserted.

Patent Document 1: Japanese Laid-Open Patent Application No. H11-086966

Patent Document 2: Japanese Laid-Open Patent Application No. H11-219756

Patent Document 3: Japanese Laid-Open Patent Application No. 2006-244774

Each of the card ejecting mechanisms of these card connectors includes many parts. Furthermore, the part where different operations are performed when a card is inserted and when a card is not inserted is narrow. These factors make it difficult to assemble the card connector.

Even when a card is not inserted, a cam follower moves along the side of the gap of the heart-shaped cam in directions toward the outward groove and/or the inward groove. Accordingly, due to assembling errors, the cam follower may erroneously enter the outward groove or the inward groove and cause a failure.

SUMMARY OF THE INVENTION

The present invention provides a card connector in which one or more of the above-described disadvantages are eliminated.

An embodiment of the present invention provides a card connector including a card ejecting mechanism including an operation member extending in a predetermined direction and configured to be pushed in the predetermined direction, a card eject rotatable member configured to rotate in conjunction with the operation member being pushed so as to push out a card inserted in the card connector in a direction counter to the predetermined direction, a transmission cam arm that rotates in conjunction with a movement of the operation member, an eject bar connected to and in conjunction with the card eject rotatable member, wherein the operation member, the transmission cam arm, and the eject bar are arranged in this order in the predetermined direction along a side surface of a main unit of the card ejecting mechanism, and a heart-shaped cam groove provided in the side surface of the main unit, the heart-shaped cam groove including a valley groove, an outgoing groove, an incoming groove, an outlet guide groove provided between the valley groove and a start-edge of the outgoing groove, and an inlet guide groove provided between an end-edge of the incoming groove and the valley groove, wherein the valley groove is provided on a side of the heart-shaped cam groove closest to the eject bar and an extended valley groove extends from the valley groove in the predetermined direction toward the eject bar, wherein the transmission cam arm includes a cam follower causing the transmission cam arm to rotate as the cam follower moves by being guided by the heart-shaped cam groove in conjunction with the movement of the operation member, the transmission cam arm being configured to communicate the movement of the operation member to the eject bar when the transmission cam arm is at a predetermined position, the eject bar includes a guide edge face provided at an end thereof on a side close to the operation member for guiding the cam follower, wherein the eject bar is positioned near the operation member when the card is in an inserted position and away from the operation member when the card is not in the inserted position, when the card is in the inserted position, the guide edge face of the eject bar is positioned near the valley groove to form a part of the outlet guide groove so that when a preparatory operation is performed, the cam follower is guided toward the outgoing groove such that the operation member protrudes outside of the card connector by a stroke length sufficient for performing an ejecting operation to eject the card, and when the card is not in the inserted position, the guide edge face of the eject bar is positioned away from the valley groove so that when the preparatory operation is performed, the cam follower is not guided toward the outgoing groove but is guided to move along into the extended valley groove and return to the valley groove, such that the operation member does not protrude outside.

According to one embodiment of the present invention, even when there are assembling errors, a failure does not occur, thus attaining high reliability.

BRIEF DESCRIPTION OF THE DRAWINGS

Other objects, features and advantages of the present invention will become more apparent from the following detailed description when read in conjunction with the accompanying drawings, in which:

FIG. 7A illustrates a conventional example and FIGS. 7B and 7C illustrate an embodiment of the present invention;

DETAILED DESCRIPTION OF THE PREFERRED EMBODIMENTS

A description is given, with reference to the accompanying drawings, of an embodiment of the present invention.

Figure 1:
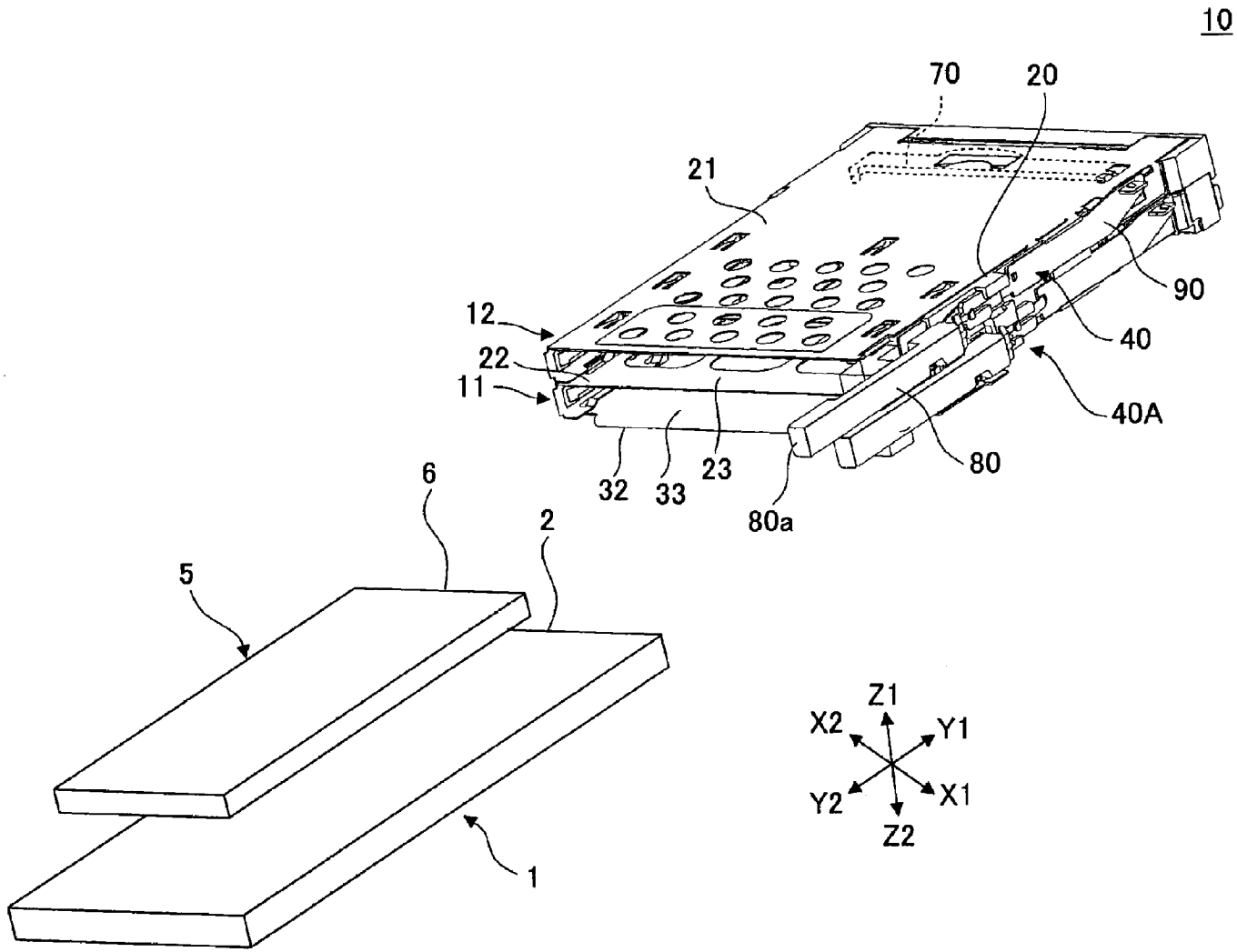
FIG. 1 is a perspective view of a card connector according to an embodiment of the present invention, shown together with a PC card and an express card.

FIG. 1 is a perspective view of a card connector 10 according to an embodiment of the present invention, shown together with a PC card 1 and an express card 5. The card connector 10 is a single component including an express card connector 12 for the express card 5 arranged on top of a PC card connector 11 for the PC card. X1 and X2 indicate left and right directions (widthwise directions), Y1 and Y2 indicate depthwise directions, and Z1 and Z2 indicate heightwise directions. Y1 corresponds to the direction in which a card is inserted and Y2 corresponds to the direction in which a card is pushed out (card ejecting direction).

Figure 2:
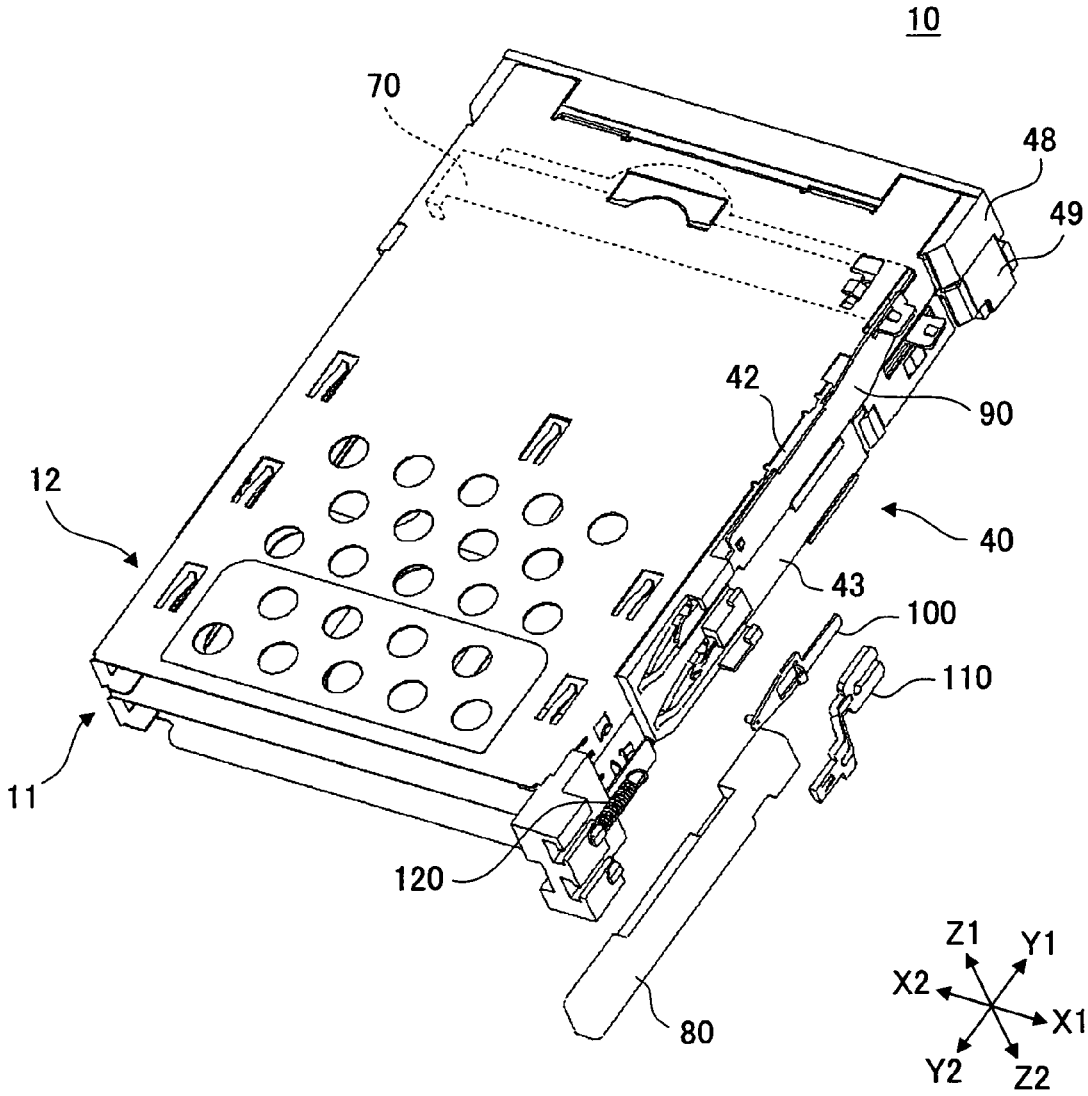
FIG. 2 is a perspective view of the card connector shown in FIG. 1 with a card ejecting mechanism shown separated from the card connector.
Figure 3:
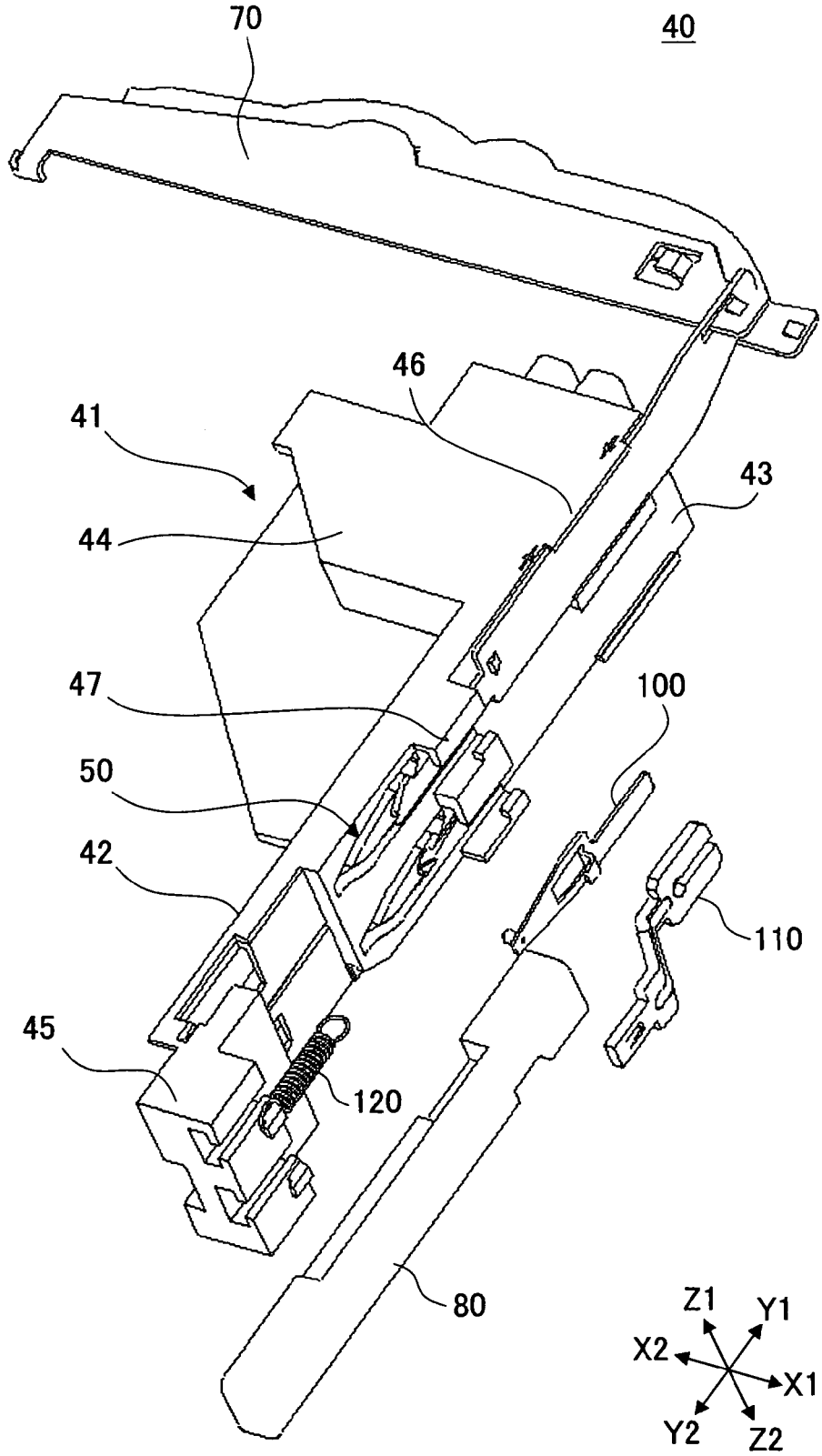
FIG. 3 is an exploded perspective view of the card ejecting mechanism of the card connector shown in FIG. 1 without the housing of the card connector.
Figure 4:
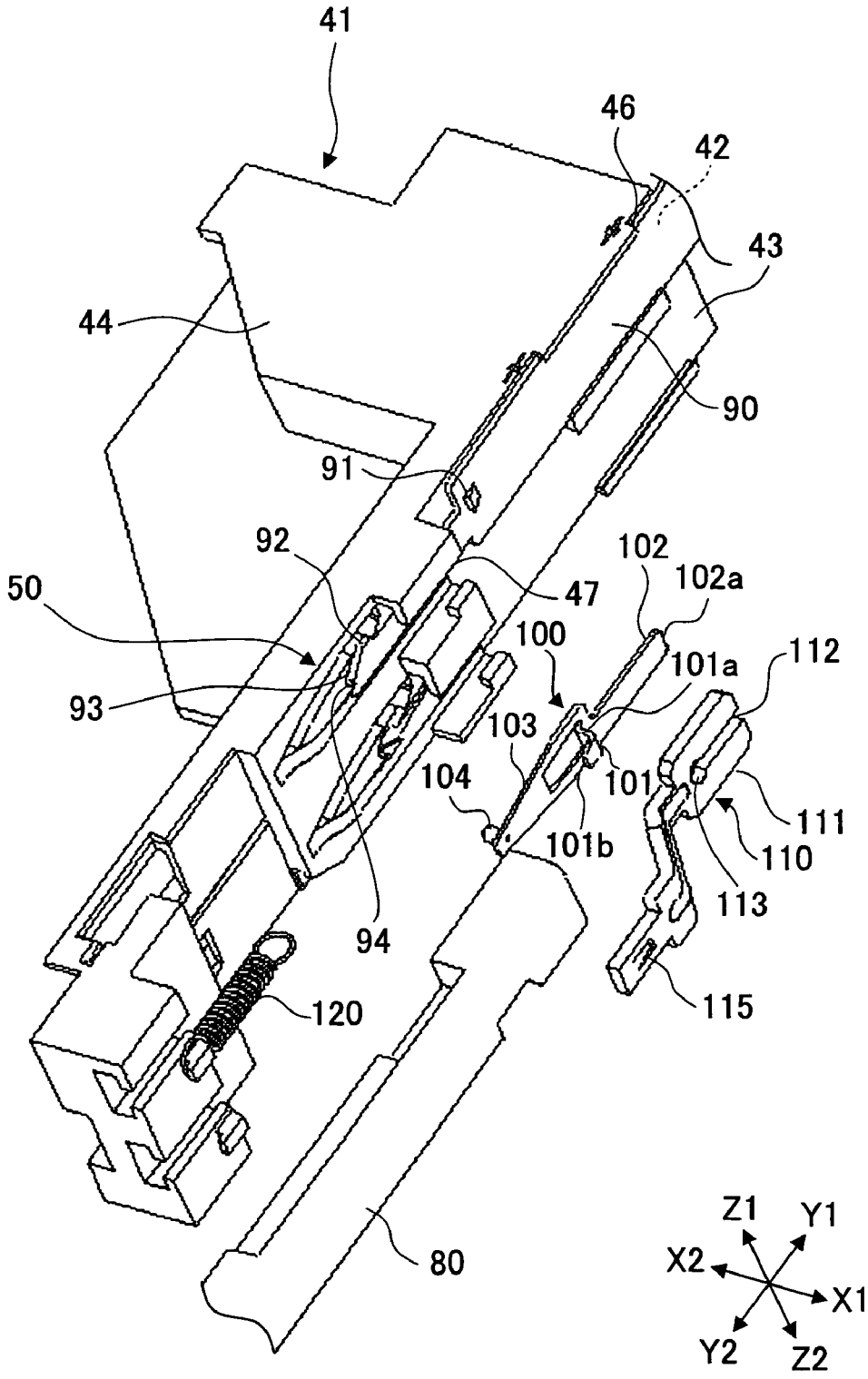
FIG. 4 is a partially enlarged view of the card ejecting mechanism shown in FIG. 3.
Figure 5:
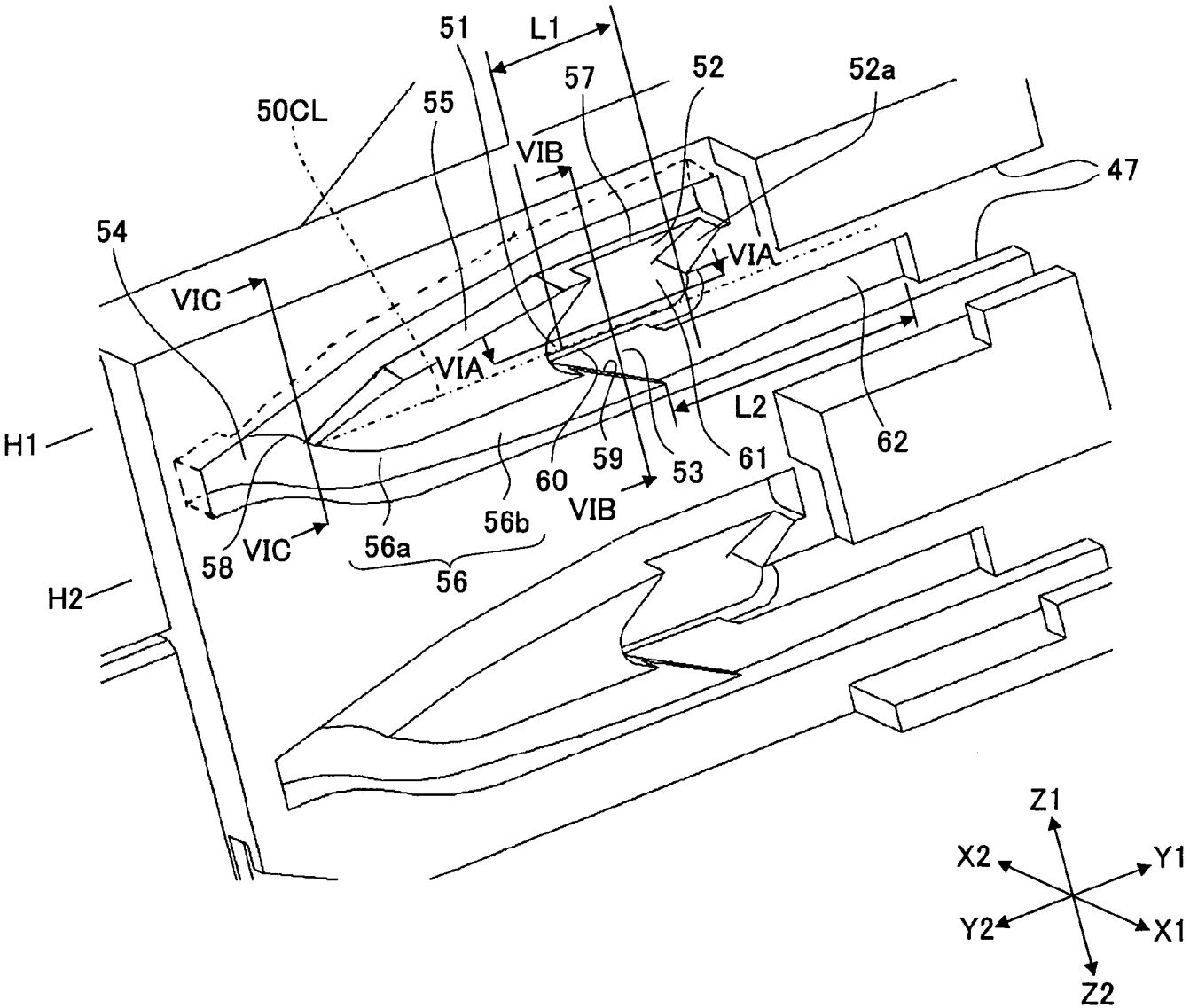
FIG. 5 is an enlarged view of a heart-shaped groove provided on the side of the card ejecting mechanism shown in FIG. 3.

A card ejecting mechanism 40 and a card ejecting mechanism 40A are provided on the side surfaces on the X1 side of the PC card connector 11 and the express card connector 12, respectively. FIG. 2 is a perspective view of the card connector 10, with the card ejecting mechanism 40 shown separated from the card connector 10. FIG. 3 is an exploded perspective view of the card ejecting mechanism 40, without the housing of the card connector 10. FIG. 4 is a partially enlarged view of the card ejecting mechanism 40. FIG. 5 is an enlarged view of a heart-shaped groove provided on the side of the card ejecting mechanism 40 shown in FIG. 3.

The express card connector 12 is configured with a rail 42 on the X1 side, a rail (not shown) on the X2 side, a top plate 21, a partition plate 22 at the bottom, a connector pin collecting block 48 at the back, the card ejecting mechanism 40, and has an insertion opening 23 on the Y2 side.

The PC card connector 11 is configured with a rail 43 on the X1 side, a rail (not shown) on the X2 side, the partition plate 22 at the top, a bottom plate 32, a connector pin collecting block 49 at the back, the card ejecting mechanism 40A, and has an insertion opening 33 on the Y2 side.

The card connector 10 is built in a portable personal computer with the insertion opening 23, the insertion opening 33, and an operation member edge 80*a* of an eject operation member 80 exposed at the side surface of the portable personal computer.

The express card 5 is inserted inside the express card connector 12 through the insertion opening 23 so that a connector 6 at the tip the express card 5 is connected and attached to a connector pin (not shown) at the back. The express card 5 can be ejected by pushing in the eject operation member 80.

The PC card 1 is inserted inside the PC card connector 11 through the insertion opening 33 so that a connector 2 at the tip of the PC card 1 is connected and attached to a connector pin (not shown). The PC card 1 can be ejected by pushing in the eject operation member 80 in the Y1 direction.

[Configuration of Card Ejecting Mechanism 40]

Next, the card ejecting mechanism 40 is described below.

As shown in FIGS. 3 and 4, the card ejecting mechanism 40 is configured with a main unit 41, a card eject rotatable lever 70, the eject operation member 80, an eject bar 90, a transmission cam arm 100, a support arm 110, and a pulling coil spring 120.

On the side surface of the main unit 41 are provided the eject operation member 80, the support arm 110, the transmission cam arm 100, and the eject bar 90 in this order from the Y2 side toward the Y1 direction.

The card eject rotatable lever 70 is supported so as to be rotatable within a predetermined angle range about a Z axis (i.e., an axis extending between the Z1 direction and the Z2 direction). The X1 end of the card eject rotatable lever 70 is connected to the Y1 end of the eject bar 90. When the express card 5 is inserted and attached as described above, the card eject rotatable lever 70 rotates in a clockwise direction as viewed from the Z1 side so that the eject bar 90 moves in the Y2 direction and reaches a position Q2 (see FIG. 9A). As the eject bar 90 moves in the Y1 direction from the position Q2 to a position Q1 (see FIG. 9E), the card eject rotatable lever 70 rotates in a counterclockwise direction as viewed from the Z1 side, and the X2 end of the card eject rotatable lever 70 pushes the express card 5 so as to eject the express card 5.

The support arm 110 protrudes from the eject operation member 80 in the Y1 direction, and supports the transmission cam arm 100. On the side surface of the rail 42 are provided the eject operation member 80, the transmission cam arm 100, and the eject bar 90 in this order from the Y2 side toward the Y1 side.

The card ejecting mechanism 40 employs a push-lock/push-return mechanism. The push-lock/push-return mechanism operates or does not operate depending on the position of the eject bar 90. When the push-lock/push-return mechanism is operating, the transmission cam arm 100 changes its position (posture) so as to push the eject bar 90. The push-lock/push-return mechanism refers to a mechanism that locks when pushed for the first time, and unlocks and returns when pushed the next time.

[Main Unit 41]

Referring to FIG. 4, the main unit 41 is a component formed by molding synthetic resin. The main unit 41 is a single component including the upper rail 42, a lower rail 43, and a guide 44 protruding from the rail 42 in the X2 direction for guiding an express card.

On the side surface of the rail 42 are formed a guide 45 for guiding the eject operation member 80, a guide 46 for guiding the eject bar 90, a guide 47 for guiding the support arm 110 and the eject bar 90, and a heart-shaped cam groove 50. As shown in FIGS. 11A-11E and 14A-14C, the guide 47 sandwiches the top and the bottom edges of a strip-like protruding section 92 of the eject bar 90 to guide the eject bar 90. The heart-shaped cam groove 50 is formed at a position corresponding to the transmission cam arm 100.

The support arm 110, the transmission cam arm 100, and the eject bar 90 overlap each other at the position of the guide 47. The guide 47 guides the support arm 110, the transmission cam arm 100, and the eject bar 90.

As shown in FIG. 5, the heart-shaped cam groove 50 is a typical heart-shaped cam groove, except for a valley groove 51. The heart-shaped cam groove 50 is arranged in a lateral direction with its center line 50CL extending in a Y direction (the Y1 and the Y2 directions), and has an elongated shape in the Y direction. The valley groove 51, an outlet guide groove 52, and an inlet guide groove 53 are provided on the Y1 side, a joining part 54 is provided on the Y2 side, an outgoing groove 55 is provided on the Z1 side (at a height H1) extending from the edge of the outlet guide groove 52 to the joining part 54, and an incoming groove 56 is provided on the Z2 side (at a height H2 lower than the height H1) extending from the joining part 54 in the Y1 direction to the inlet guide groove 53. The incoming groove 56 includes a curved part 56*a* at the starting edge that extends toward the Z2 direction and then toward the Y1 direction, followed by a horizontal part 56*b* that extends toward the Y1 direction. The incoming groove 56 has a function of transmitting the position (rotational position) of the transmission cam arm 100, which is rotated when the eject operation member 80 is pushed in, to the eject bar 90.

Figure 6A:
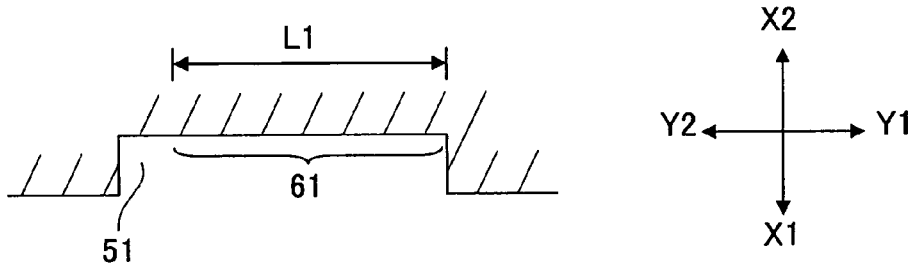
FIGS. 6A-6C are sectional views of the heart-shaped groove.
Figure 6B:
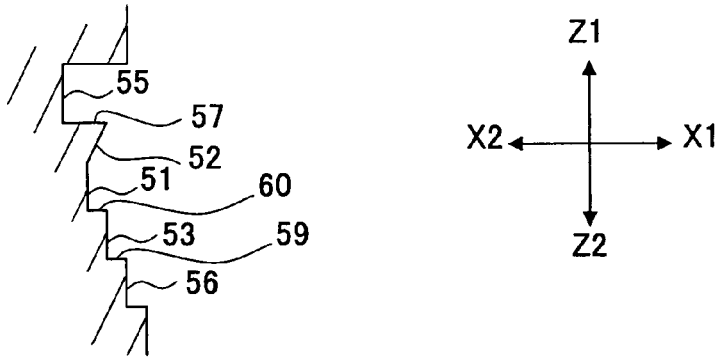
Figure 6C:
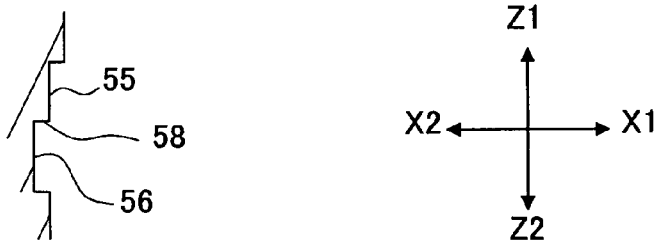

As shown in FIG. 6B, the surface of the outlet guide groove 52 is an ascending slant, and has a step part 57 at the edge thereof extending onto the outgoing groove 55. As shown in FIG. 6C, the joining part 54 has a step part 58 that extends from the end edge of the outgoing groove 55 onto the incoming groove 56. As shown in FIG. 6B, there is a step part 59 that extends from the end edge of the incoming groove 56 (horizontal part 56*b*) onto the inlet guide groove 53, and a step part 60 that extends from the inlet guide groove 53 onto the valley groove 51.

Figure 7A:
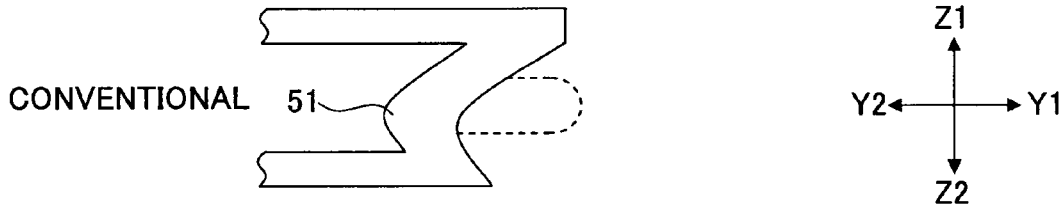
FIGS. 7A-7C are enlarged views of a part near the valley groove of the heart-shaped cam groove, where

As shown in FIGS. 5 and 6A, there is an extended valley groove 61 extending in the Y1 direction from the valley groove 51, which extended valley groove 61 has a relatively long length L1. The length L1 is long enough for a preparatory operation to be described below, facilitating a smooth preparatory operation. The extended valley groove 61 has a width W1 into which a cam follower 104 can be movably fitted as described below. FIG. 7A is an enlarged view of a part near the valley groove of a conventional heart-shaped cam groove. The heart-shaped cam groove 50 according to an embodiment of the present invention can be realized by extending the valley groove of the conventional heart-shaped cam groove in the Y1 direction as indicated by dashed lines in FIG. 7A. By extending the valley groove in the Y1 direction, part of a wall on the Y1 side of the outlet guide groove 52 and the entire wall on the Y1 side of the inlet guide groove 53 are broken down and eliminated. A slanted wall 52*a* on the Y1 side of the outlet guide groove 52 is only present on the side near the outgoing groove 55, and is absent where the extended valley groove 61 is located. By making the outlet guide groove 52 have such an incomplete (partial) wall 52*a* in such a manner that the wall is absent where the extended valley groove 61 is located, there is no wall present for guiding the cam follower 104 toward the outgoing groove 55 when the cam follower 104 moves in the Y1 direction. Accordingly, the cam follower 104 is prevented from moving toward the outgoing groove 55.

An incoming extended groove 62 extends in the Y1 direction from the incoming groove 56 and past the position of the inlet guide groove 53, which incoming extended groove 62 has a relatively long length L2. The incoming extended groove 62 is formed so that the main operation is normally performed and the operation member edge 80*a* moves past a position S3 to a position S1 (see FIG. 9E).

As the incoming extended groove 62 is formed (and the wall of the outlet guide groove 52 is eliminated), the eject bar 90 is made to have a guide edge face 93 on the Y2 edge thereof that compensates for the absent slanted wall of the outlet guide groove 52 on the Y1 side.

Furthermore, the incoming extended groove 62 is positioned at the lower position H2 in the heightwise direction. Therefore, the transmission cam arm 100 can be rotated to such a position that pushes the eject bar 90.

[Eject Operation Member 80]

As shown in FIGS. 1-3, the eject operation member 80 is a so called push rod formed by molding synthetic resin. The sectional shape of the rod is a square. The eject operation member 80 is supported by the guide 45 so as to be slidable within a predetermined range in the Y direction, and is pushed in the Y2 direction by the pulling coil spring 120. Under normal circumstances, the eject operation member 80 is positioned where the operation member edge 80*a* is at an S4 position.

[Eject Bar 90]

As shown in FIGS. 3 and 4, the eject bar 90 is made of sheet metal and extends lengthwise in the Y direction. The eject bar 90 is supported by the guide 46 so as to be movable within a predetermined range in the Y direction. The Y1 end of the eject bar 90 is connected to the X1 end of the card eject rotatable lever 70.

At a portion of the eject bar 90 near the Y2 end and on the Z1 side with respect to a center line in the lengthwise direction thereof, a protrusion 91 is formed by cutting and raising the portion to protrude in the X1 direction.

On the Y2 end of the eject bar 90, the strip-like protruding section 92 is protruding in the Y2 direction. The strip-like protruding section 92 has a width W2, which corresponds to the width of the extended valley groove 61 and the width of the incoming extended groove 62 added together. The tip of the strip-like protruding section 92 is a substantially triangular shape, including the slanted guide edge face 93 and a vertical edge face 94. The vertical edge face 94 is formed on the Z2 side of the tip of the guide edge face 93.

The strip-like protruding section 92 is supported by the guide 47 so as to be fixed in the Z direction (the Z1 and the Z2 directions). Specifically, the top and bottom edges of the strip-like protruding section 92 are supported by the guide 47 of the main unit 41 so as to be fixed in the Z direction at a position corresponding to the extended valley groove 61 and the incoming extended groove 62.

When the express card 5 is not inserted, the eject bar 90 is at a position P1 (see FIG. 7B), and the guide edge face 93 is spaced away from the valley groove 51 in the Y1 direction and is positioned further toward the Y1 direction than the Y1 edge of the extended valley groove 61.

Figure 7B:
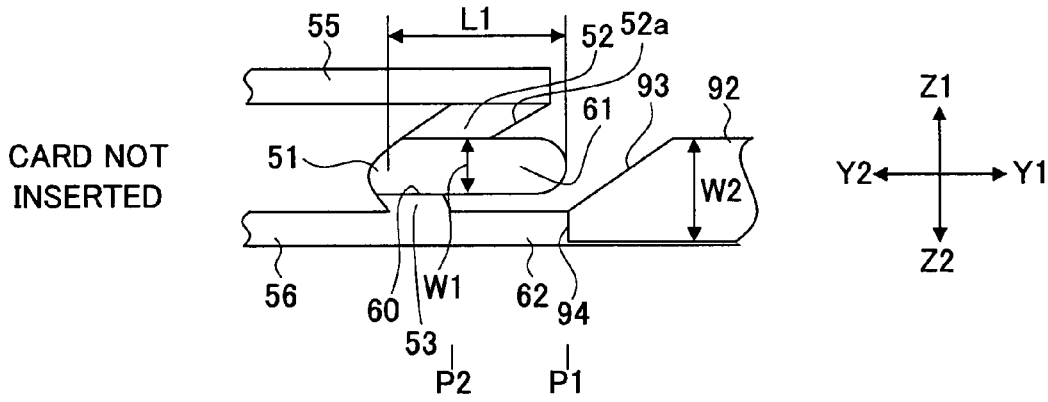
Figure 7C:
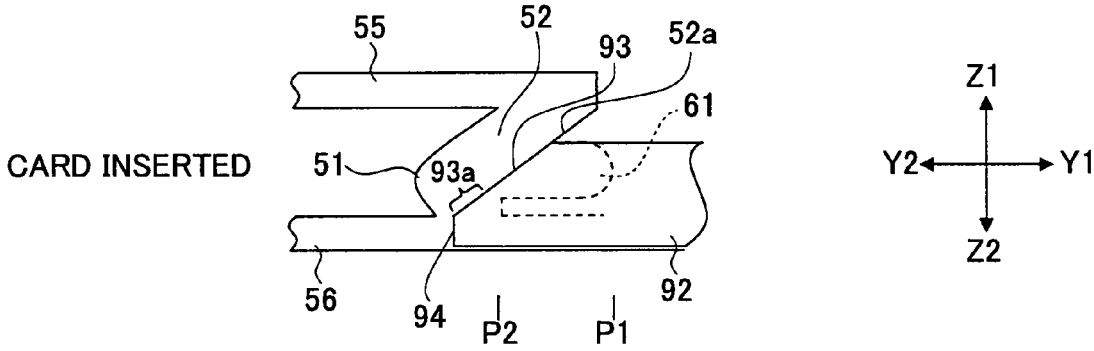

When the express card 5 is inserted, as shown in FIG. 7C, the eject bar 90 is at a position P2, the strip-like protruding section 92 is covering part of the extended valley groove 61, and the guide edge face 93 is near the valley groove 51 and is aligned with an extended line of the wall 52*a*, so that the outlet guide groove 52 has a complete shape to function normally. As shown in FIG. 7C, a tip 93*a* and the vertical edge face 94 of the guide edge face 93 are sealing the inlet guide groove 53.

[Transmission Cam Arm 100]

As shown in FIG. 4, the transmission cam arm 100 is made of sheet metal and extends lengthwise in the Y direction. The transmission cam arm 100 includes an L-shaped stem-like part 101 formed by cutting and raising a middle portion thereof in the X1 direction and bending the tip in the Y2 direction. The transmission cam arm 100 further includes a pushing arm 102 extending from the stem-like part 101 in the Y1 direction and an arm 103 extending from the stem-like part 101 in the Y2 direction. The stem-like part 101 includes a standing portion 101*a* that is standing up and a bent portion 101*b* at the tip. The pushing arm 102 includes a planar tip portion 102*a*. At the end of the arm 103 is provided the pin-shaped cam follower 104 protruding in the X2 direction. The cam follower 104 is formed by performing a drawing process on a part of the arm 103. The cam follower 104 can also be formed by embedding a pin member into the arm 103.

An elastic force is generated by the transmission cam arm 100 itself because the transmission cam arm 100 elastically bends (the arm 103 particularly elastically bends easily because it has the opening). This elastic force pushes the cam follower 104 in the X2 direction so that the tip of the cam follower 104 abuts the bottom of the cam groove 50 and the cam follower 104 smoothly climbs over the ascending slant of the outlet guide groove 52, etc.

[Support Arm 110]

As shown in FIG. 4, the support arm 110 is formed by molding synthetic resin, and has a substantially crank-like shape as viewed from the Z1 side. At the end of the support arm 110 in the Y1 direction is provided a transmission cam arm support section 111. At the end of the support arm 110 in the Y2 direction is provided an insertion section 115. The transmission cam arm support section 111 includes a slit 112 extending from the tip toward the Y2 direction and a hole 113 at the end of the slit 112.

The insertion section 115 of the support arm 110 is inserted into a hole at the Y1 end of the eject operation member 80, so that the support arm 110 is fixed to the eject operation member 80 and protrudes from the eject operation member 80 in the Y1 direction. The transmission cam arm 100 is attached to the transmission cam arm support section 111 so that the lengthwise center line of the transmission cam arm 100 matches the Y axis (the Y1 and the Y2 directions). Specifically, the stem-like part 101 of the transmission cam arm 100 is supported in the hole 113 of the transmission cam arm support section 111 so as to be rotatable within a predetermined angle range but not to be disengaged.

Figure 8A:
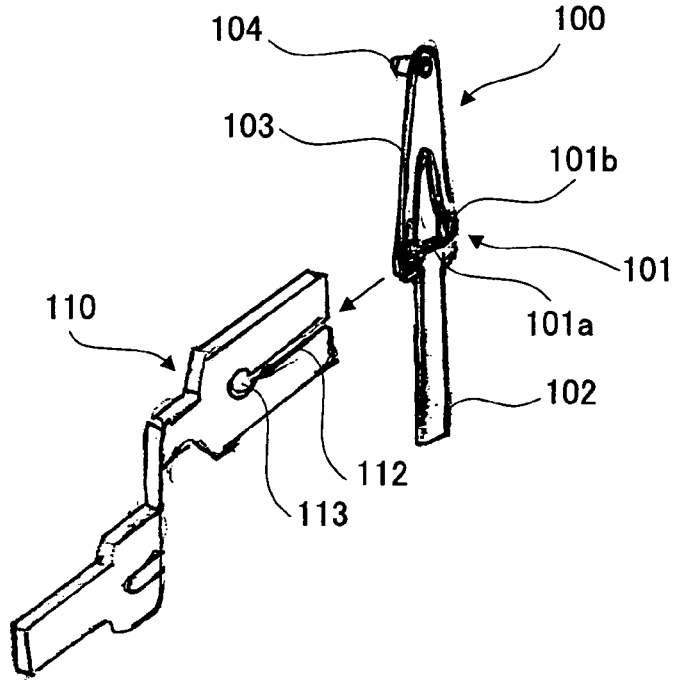
FIGS. 8A-8C illustrate how a transmission cam arm is attached to a support arm.
Figure 8B:
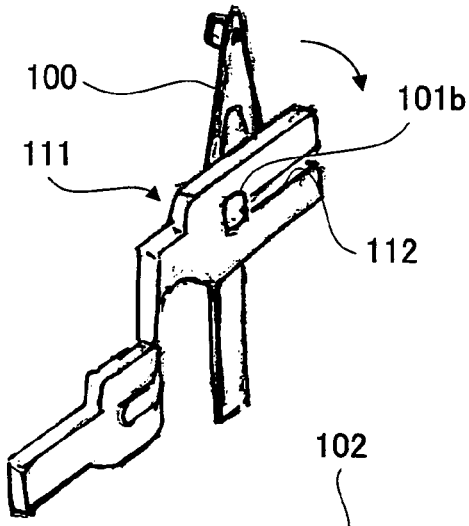
Figure 8C:
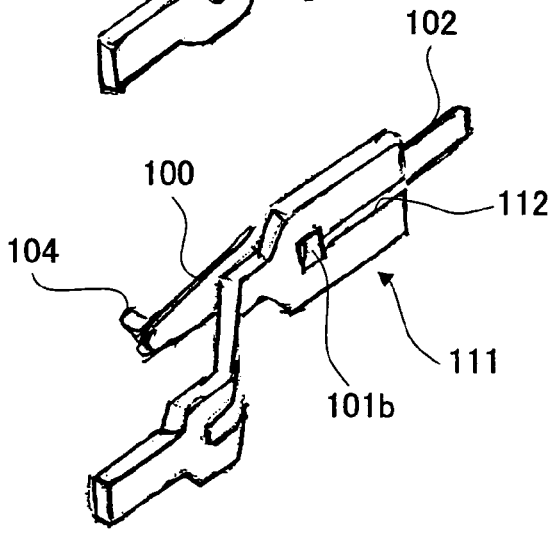

The width of the slit 112 is approximately the same as the thickness of the standing portion 101*a* of the transmission cam arm 100. As shown in FIGS. 8A-8C, the transmission cam arm 100 is oriented in a perpendicular direction with respect to the support arm 110, and the standing portion 101*a* is slid into the slit 112 in this posture. When the standing portion 101*a* reaches the hole 113, the transmission cam arm 100 is rotated 90 degrees so that it does not disengage from the support arm 110. As described above, the transmission cam arm 100 can be easily attached to the support arm 110.

The arm 103 of the transmission cam arm 100 elastically bends so that the transmission cam arm 100 generates an elastic force. This elastic force pushes the cam follower 104 in the X2 direction so that the tip of the cam follower 104 abuts the bottom of the cam groove 50 and the cam follower 104 smoothly climbs over the ascending slant of the outlet guide groove 52, etc.

The card ejecting mechanism 40A provided on the side of the bottom rail 43 of the main unit 41 is the same as the card ejecting mechanism 40.

[Operations of the Card Ejecting Mechanism 40]

Figure 9A:
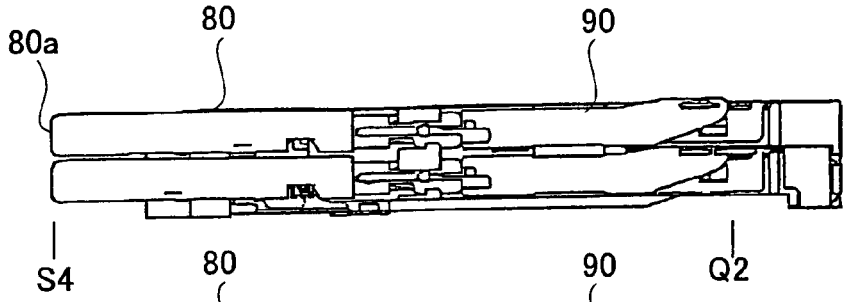
FIGS. 9A-9E are side views of the card connector illustrating the process of ejecting an express card.
Figure 9B:
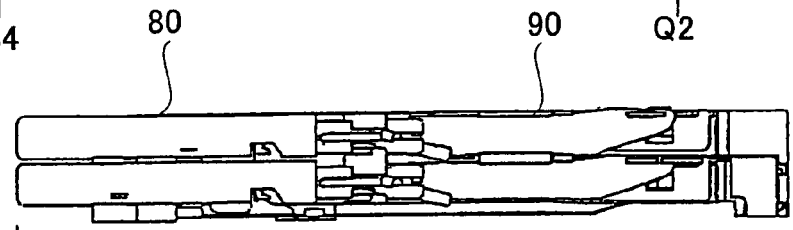
Figure 9C:
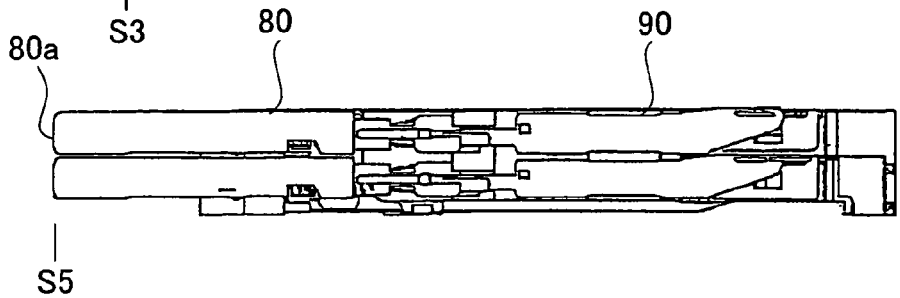

The card connector 10 is built in a portable personal computer in such a manner that the position S3 shown in FIG. 9B substantially matches the side surface of the portable personal computer.

(1) Operations for Inserting Express Card 5

FIGS. 9A-9E are side views of the card connector 10 illustrating the process of ejecting the express card 5. FIGS. 10A-10E illustrate the operations of the transmission cam arm 100 and the eject bar 90 corresponding to statuses shown in FIGS. 9A-9E, respectively. FIGS. 11A-11E illustrate the positions and movements of the cam follower 104 in the heart-shaped cam groove 50 corresponding to statuses shown in FIGS. 10A-10E, respectively.

Figure 10A:
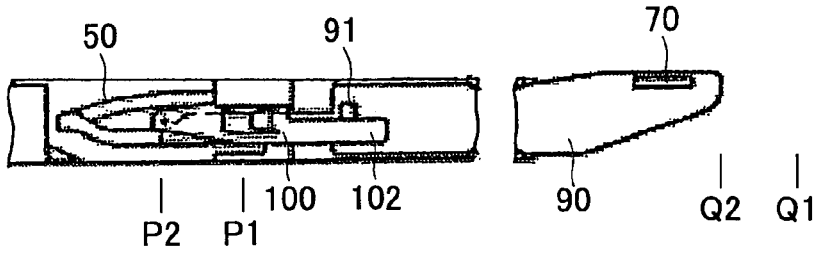
FIGS. 10A-10E illustrate the operations of the transmission cam arm and the eject bar.
Figure 10B:
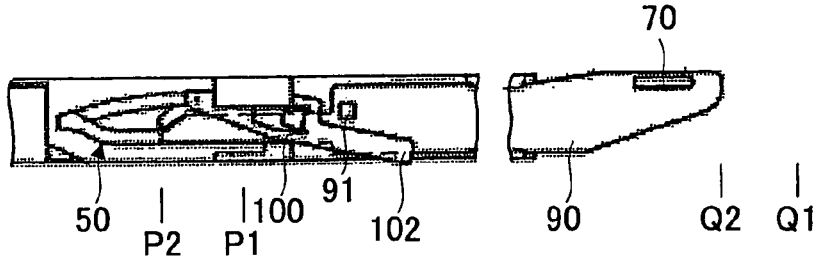
Figure 10C:
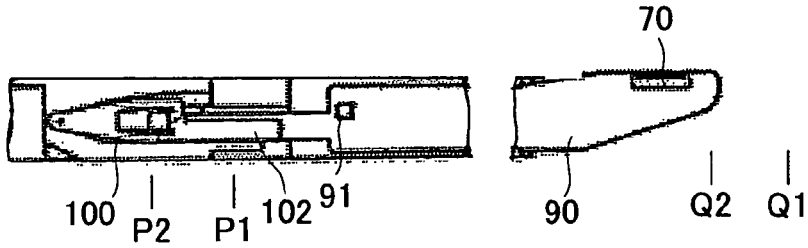
Figure 11A:
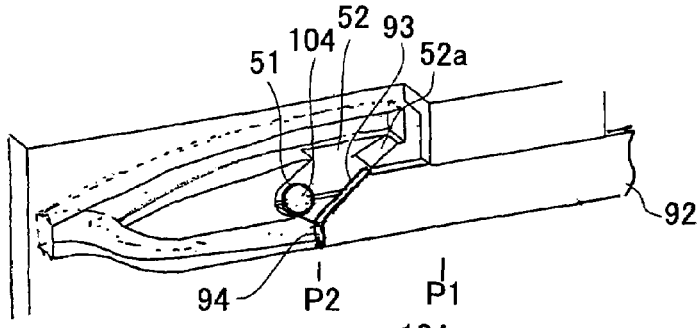
FIGS. 11A-11E illustrate the positions and movements of a cam follower in the heart-shaped cam groove.
Figure 11B:
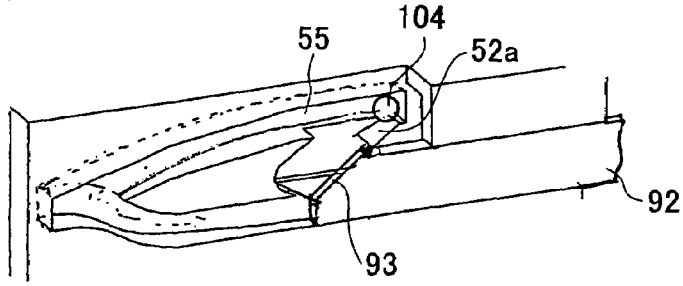
Figure 11C:
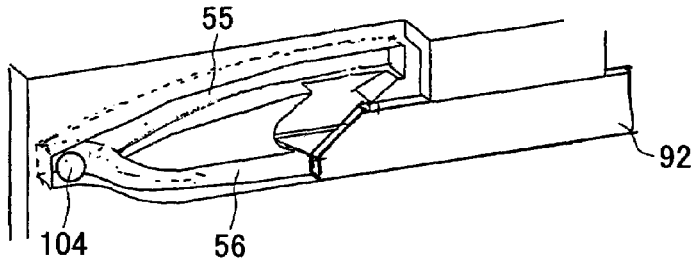

FIG. 9A illustrates the status when the express card 5 is inserted. The card eject rotatable lever 70 is pushed by the tip of the inserted express card 5 so as to rotate in a clockwise direction, and is wedged in that position. The Y2 end of the eject bar 90 is positioned at Q2, and the Y2 end of the eject operation member 80 is positioned at S4. The respective positions are in the following order in the direction from Y1 to Y2: S1, S2 (see FIG. 12B), S3, S4, S5; P1, P2; and Q1, Q2. As shown in FIG. 10A, the Y2 end of the eject bar 90 is at P2. As shown in FIG. 11A and FIG. 7C, the guide edge face 93 is aligned with the extended line of the wall 52*a*, and does not easily move from this position; therefore, the outlet guide groove 52 can function normally in this status. The cam follower 104 is positioned in the valley groove 51. As shown in FIG. 10A, the transmission cam arm 100 is positioned horizontally, and the pushing arm 102 is positioned on the Z2 side of the protrusion 91.

First, the preparatory operation is performed. Specifically, the user pushes the eject operation member 80 with his finger tip to temporarily push in the eject operation member 80, and then releases his fingertip.

When the eject operation member 80 is pushed by the user's fingertip, the eject operation member 80 is pushed in a direction counter to the force of the pulling coil spring 120, until it reaches the position S3, which is the endmost position (see FIG. 9B) at this stage. During this movement, the cam follower 104 is guided first by the guide edge face 93 and then by the wall 52*a* to move along the outlet guide groove 52 until it climbs over the step part 57 and reaches the outgoing groove 55 (see FIG. 11B). Accordingly, the transmission cam arm 100 is caused to move in the Y1 direction and tilt by rotating in the clockwise direction (see FIG. 9B). The vertical edge face 94 is sealing the inlet guide groove 53, and therefore, the cam follower 104 is prevented from moving toward the inlet guide groove 53, thereby enhancing reliability of the operation.

When the user releases his fingertip, the eject operation member 80 returns toward the Y2 direction due to the force of the pulling coil spring 120. Accordingly, the cam follower 104 moves along the outgoing groove 55 in the Y2 direction to the joining part 54, past the step part 58, and reaches the incoming groove 56 (see FIG. 11C). The eject operation member 80 passes the position S4 and reaches the position S5, greatly protruding from the side surface of the portable personal computer, so that a sufficient stroke length is attained (see FIG. 9C). The transmission cam arm 100 moves in the Y2 direction and rotates in a counterclockwise direction so as to be in a horizontal position (see FIG. 10C).

Next, the main operation is performed. Specifically, the user pushes in with his finger tip the eject operation member 80 past the position shown in FIG. 9D, past the position S3, and to the endmost position S1, which is the endmost position at this stage, as shown in FIG. 9E.

When the user pushes with his fingertip the eject operation member 80, the cam follower 104 moves this time along the incoming groove 56 in the Y1 direction.

Figure 9D:
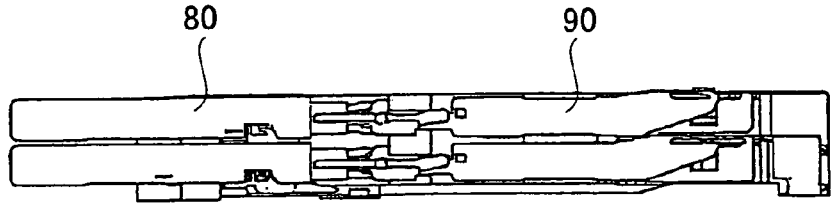
Figure 9E:
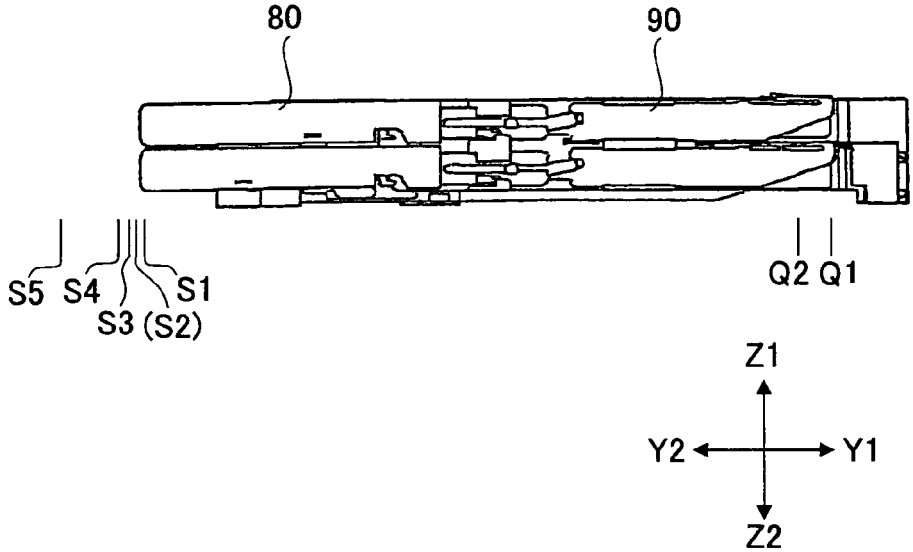
Figure 10D:
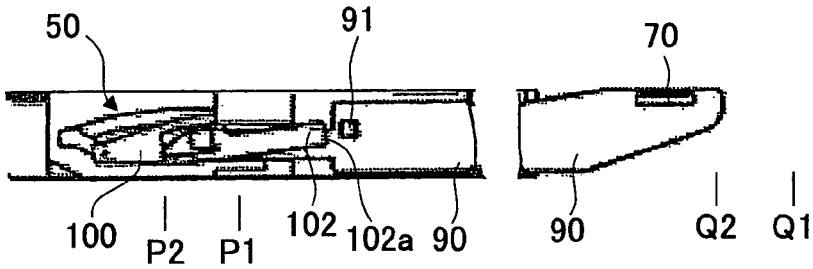
Figure 10E:
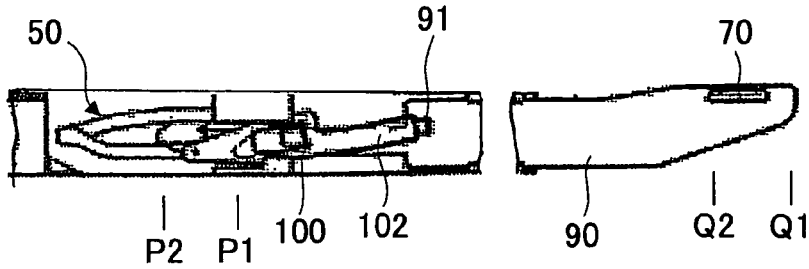
Figure 10E:
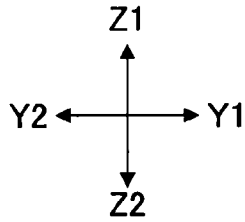
Figure 11D:
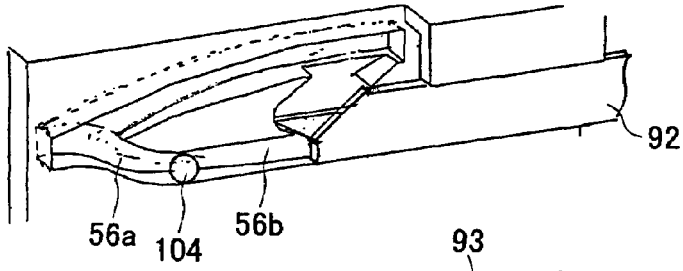

When the eject operation member 80 is pushed into the position shown in FIG. 9D, the cam follower 104 is located at a position just past the first curved part 56*a* of the incoming groove 56, as shown in FIG. 11D. As shown in FIG. 10D, the transmission cam arm 100 is rotated in the counterclockwise direction as it moves in the Y1 direction so that the pushing arm 102 is slanted upward and the tip portion 102*a* of the pushing arm 102 is facing the protrusion 91 of the eject bar 90.

When the eject operation member 80 is pushed further in, the cam follower 104 moves along the horizontal part 56*b*, the transmission cam arm 100 moves in the Y1 direction while maintaining the above-described position so that the tip portion 102*a* of the pushing arm 102 abuts the protrusion 91, and the eject bar 90 is moved in the Y1 direction. Accordingly, the card eject rotatable lever 70 starts rotating in a counterclockwise direction as viewed from the Z1 side.

Figure 11E:
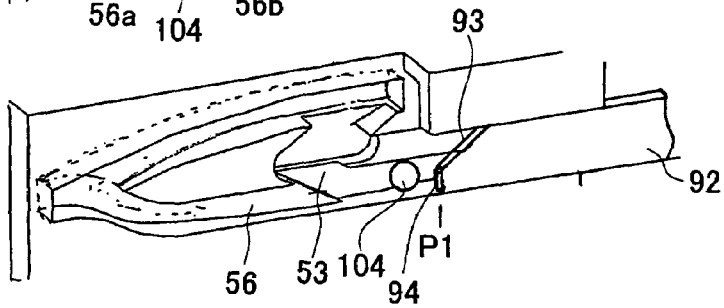
Figure 11E:
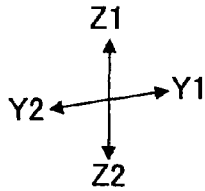

The cam follower 104 moves past the step part 59 and reaches the inlet guide groove 53. At this point, the guide edge face 93 and the vertical edge face 94 of the eject bar 90 will have been moved back in the Y1 direction. Therefore, the cam follower 104 moves along the incoming extended groove 62 further in Y1 direction without colliding with the vertical edge face 94, as shown in FIG. 11E.

Meanwhile, the transmission cam arm 100 maintains the above-described position, and the eject operation member 80 is pushed to the endmost position S1 in the Y1 direction while the causing the eject bar 90 to move in the Y1 direction via the transmission cam arm 100.

The express card 5 is ejected due to the rotation of the card eject rotatable lever 70.

When the user releases his fingertip from the eject operation member 80, the pulling coil spring 120 forces the eject operation member 80 back toward the Y2 direction, the cam follower 104 moves along the incoming extended groove 62 in the Y2 direction, past the inlet guide groove 53 and the step part 60 and back to the valley groove 51, returning to its original position as shown in FIG. 11A.

(2) Operations when Express Card 5 is not Inserted

Figure 12A:
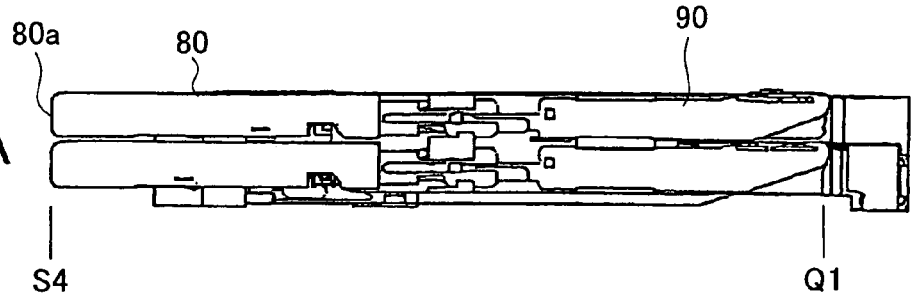
FIGS. 12A-12C are side views of the card connector illustrating an operation of the eject operation member when a card is not inserted.
Figure 12B:
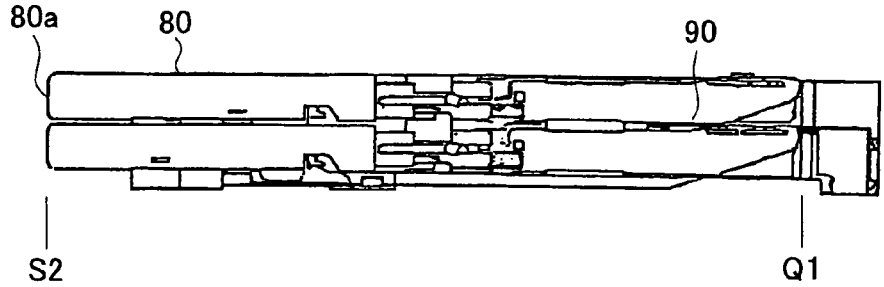
Figure 12C:
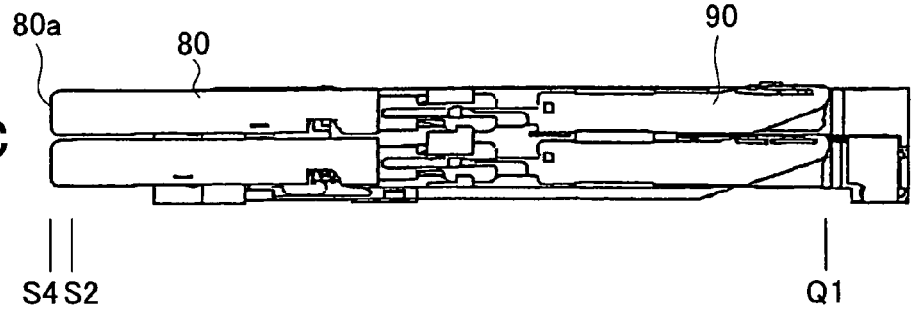
Figure 12C:
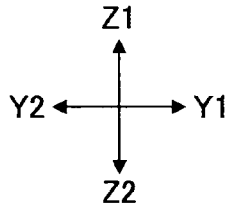
Figure 13A:
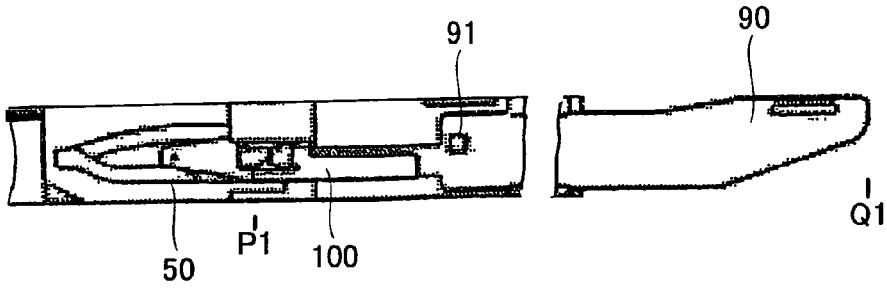
FIGS. 13A-13C illustrate the operations of the transmission cam arm and the eject bar when a card is not inserted.
Figure 13B:
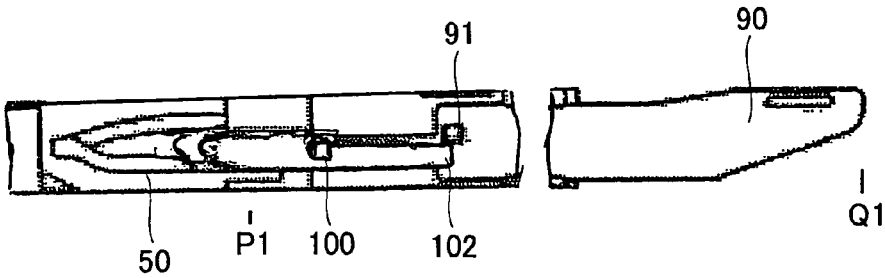
Figure 13C:
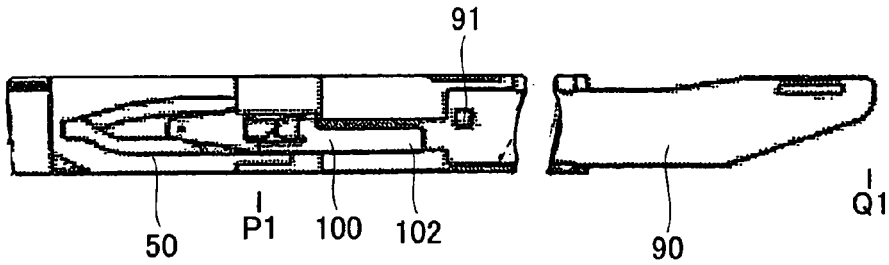
Figure 13C:
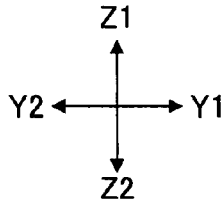
Figure 14A:
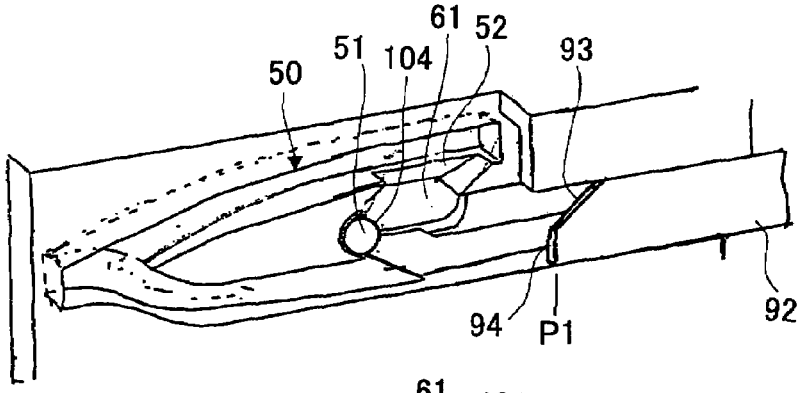
FIGS. 14A-14C illustrate the positions and movements of a cam follower in the heart-shaped cam groove when a card is not inserted.
Figure 14B:
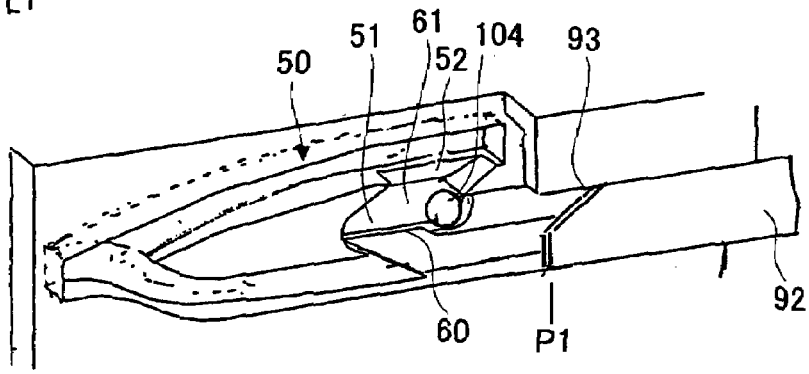
Figure 14C:
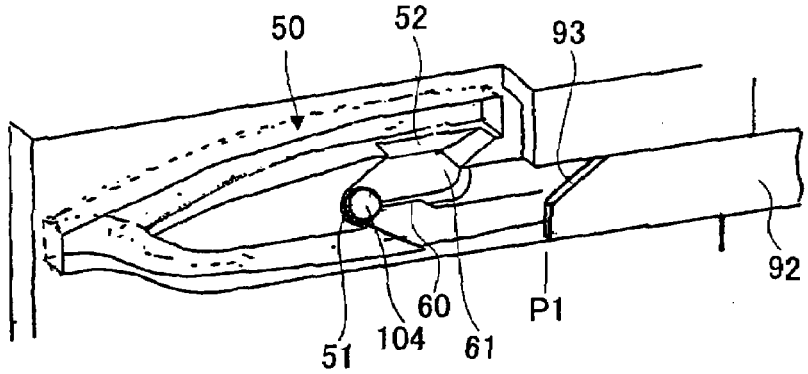
Figure 14C:
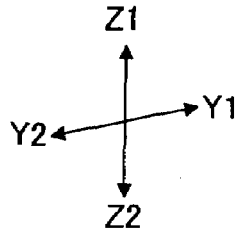

FIGS. 12A-12C are side views of the card connector 10 illustrating an operation of the eject operation member 80. FIGS. 13A-13C illustrate the operations of the transmission cam arm 100 and the eject bar 90 corresponding to statuses shown in FIGS. 12A-12C, respectively. FIGS. 14A-14C illustrate the positions and movements of the cam follower 104 in the heart-shaped cam groove 50 corresponding to statuses shown in FIGS. 13A-13C, respectively.

FIG. 12A illustrates the status when the express card 5 is not inserted, and the eject bar 90 is moved back in the Y1 direction. As shown in FIG. 13A, the Y1 end of the eject bar 90 is at the position Q1. As shown in FIG. 14A and FIG. 7B, the guide edge face 93 is positioned further toward the Y1 direction than the extended valley groove 61, and therefore, the outlet guide groove 52 is not in a condition to function normally (i.e., incapable of guiding the cam follower 104). The cam follower 104 is positioned in the valley groove 51. As shown in FIG. 13A, the transmission cam arm 100 is positioned horizontally and the pushing arm 102 is positioned further toward the Z2 direction than the protrusion 91.

Similarly to the case where the express card 5 is inserted, the preparatory operation is performed. However, in this case, when the user pushes the eject operation member 80, the cam follower 104 is not guided by the wall 52*a*, and thus moves along into the extended valley groove 61 in the Y1 direction to the endmost position as shown in FIG. 14B and abuts the wall on the Y1 side of the extended valley groove 61 until it cannot move any further. As shown in FIG. 12B, the eject operation member 80 is pushed in to the endmost position S2 at this stage. As shown in FIG. 13B, the pushing arm 102 of the transmission cam arm 100 does not collide with the protrusion 91.

The fact that the outlet guide groove 52 is at an ascending slant ensures that the cam follower 104 does not move toward the outlet guide groove 52. Furthermore, the fact that the step part 60 is higher than the cam follower 104 ensures that the cam follower 104 does not move toward the inlet guide groove 53.

When the user releases his fingertip, the eject operation member 80 returns toward the Y2 direction due to the force of the pulling coil spring 120. Accordingly, the cam follower 104 moves along into the extended valley groove 61 in the Y2 direction back to the valley groove 51, as shown in FIG. 14C. The transmission cam arm 100 returns to its original position as shown in FIG. 13C, and the eject operation member 80 returns to its original position S4 as shown in FIG. 12C. The eject operation member 80 does not protrude outward.

When the express card 5 is not inserted, the card eject rotatable lever 70 can rotate freely. Accordingly, the eject bar 90 may move in the Y2 direction. However, as the card eject rotatable lever 70 can rotate freely, the eject bar 90 easily moves in the Y1 direction if pushed in the Y1 direction. Thus, if the cam follower 104 hits the guide edge face 93 in the preparatory operation, the eject bar 90 moves in the Y1 direction, so that the cam follower 104 moves along into the extended valley groove 61 in the Y1 direction as described above.

The card ejecting mechanism 40A for the PC card connector 11 operates in the same manner as the card ejecting mechanism 40. That is, when the PC card is inserted, the operation member protrudes outside in the preparatory operation, and when the PC card is not inserted, the operation member does not protrude outside even if the preparatory operation is performed.

The transmission cam arm 100 can be directly attached to the eject operation member 80. In this case, the support arm 110 can be omitted.

The present invention can also be realized if the card connector 10 is configured with only the express card connector 12 or only the PC card connector 11.

The present invention is not limited to the specifically disclosed embodiment, and variations and modifications may be made without departing from the scope of the present invention.

What is claimed is:

1. A card connector comprising:

a card ejecting mechanism including an operation member extending in a predetermined direction and configured to be pushed in the predetermined direction, a card eject rotatable member configured to rotate in conjunction with the operation member being pushed so as to push out a card inserted in the card connector in a direction counter to the predetermined direction, a transmission cam arm that rotates in conjunction with a movement of the operation member, an eject bar connected to and in conjunction with the card eject rotatable member, wherein the operation member, the transmission cam arm, and the eject bar are arranged in this order in the predetermined direction along a side surface of a main unit of the card ejecting mechanism, and a heart-shaped cam groove provided in the side surface of the main unit, the heart-shaped cam groove including a valley groove, an outgoing groove, an incoming groove, an outlet guide groove provided between the valley groove and a start-edge of the outgoing groove, and an inlet guide groove provided between an end-edge of the incoming groove and the valley groove, wherein the valley groove is provided on a side of the heart-shaped cam groove closest to the eject bar and an extended valley groove extends from the valley groove in the predetermined direction toward the eject bar, wherein the transmission cam arm includes a cam follower causing the transmission cam arm to rotate as the cam follower moves by being guided by the heart-shaped cam groove in conjunction with the movement of the operation member, the transmission cam arm being configured to communicate the movement of the operation member to the eject bar when the transmission cam arm is at a predetermined position, the eject bar includes a guide edge face provided at an end thereof on a side close to the operation member for guiding the cam follower, wherein the eject bar is positioned near the operation member when the card is in an inserted position and away from the operation member when the card is not in the inserted position, when the card is in the inserted position, the guide edge face of the eject bar is positioned near the valley groove to form a part of the outlet guide groove so that when a preparatory operation is performed, the cam follower is guided toward the outgoing groove such that the operation member protrudes outside of the card connector by a stroke length sufficient for performing an ejecting operation to eject the card, and when the card is not in the inserted position, the guide edge face of the eject bar is positioned away from the valley groove so that when the preparatory operation is performed, the cam follower is not guided toward the outgoing groove but is guided to move along into the extended valley groove and return to the valley groove, such that the operation member does not protrude outside.

2. The card connector according to claim 1, wherein the outlet guide groove of the heart-shaped cam groove is on an ascending slant.

3. The card connector according to claim 1, wherein a support arm is fixed to the operation member, and the transmission cam arm is rotatably supported by the support arm.

4. The card connector according to claim 1, wherein the transmission cam arm includes a pushing arm extending toward the eject bar, the eject bar includes a protrusion, and while the cam follower is being guided by the incoming groove, the transmission cam arm comes to the predetermined position such that a tip of the pushing arm faces the protrusion of the eject bar, and the transmission cam arm pushes the eject bar in conjunction with the operation member being pushed to perform the ejecting operation.

5. The card connector according to claim 1, wherein the main unit is a single component including an express card guiding unit configured to guide an inserted express card so as to face a connector pin located at the back thereof.

6. The card connector according to claim 1, wherein the eject bar includes a strip-like protruding section provided on the side thereof close to the operation member, the guide edge face is provided at the tip of the strip-like protruding section, and when the eject bar is positioned near the operation member, a tip portion of the guide edge face seals the inlet guide groove.

7. The card connector according to claim 6, wherein the main unit includes a guide configured to support top and bottom edges of the strip-like protruding section of the eject bar.

8. The card connector according to claim 6, wherein the heart-shaped cam groove includes an incoming extended groove extending from the incoming groove toward the eject bar, and the strip-like protruding section of the eject bar is configured to face the extended valley groove and the incoming extended groove.

* * * * *